US012345071B2

(12) United States Patent
Agrikli

(10) Patent No.: US 12,345,071 B2
(45) Date of Patent: Jul. 1, 2025

(54) AUTOMATED PARKING FLOOR CONVEYOR SYSTEMS

(71) Applicant: OTOMATIK OTOPARK SISTEMLERI SAN. VE TIC. A.S., Ciftlikkoy/Yalova (TR)

(72) Inventor: Mustak Agrikli, Ciftlikkoy/Yalova (TR)

(73) Assignee: OTOMATIK OTOPARK SISTEMLERI SAN. VE TIC. A.S., Ciftlikkoy/Yalova (TR)

( * ) Notice: Subject to any disclaimer, the term of this patent is extended or adjusted under 35 U.S.C. 154(b) by 293 days.

(21) Appl. No.: 18/004,606

(22) PCT Filed: Jun. 11, 2021

(86) PCT No.: PCT/TR2021/050570

§ 371 (c)(1),
(2) Date: Jan. 6, 2023

(87) PCT Pub. No.: WO2021/257030

PCT Pub. Date: Dec. 23, 2021

(65) Prior Publication Data

US 2023/0243173 A1 Aug. 3, 2023

(30) Foreign Application Priority Data

Jun. 15, 2020 (TR) ..... 2020/09190

(51) Int. Cl.
*E04H 6/22* (2006.01)
*E04H 6/20* (2006.01)

(52) U.S. Cl.
CPC ..... *E04H 6/22* (2013.01); *E04H 6/20* (2013.01)

(58) Field of Classification Search
CPC ..... E04H 6/20; E04H 6/22; B65G 17/002; B65G 17/065; B65G 17/067; B65G 2201/0267
See application file for complete search history.

(56) References Cited

U.S. PATENT DOCUMENTS 4,307,985 A * 12/1981 Desprez ..... E04H 6/34 248/346.02
2009/0053025 A1 2/2009 Venkatraman et al.
2017/0247202 A1* 8/2017 Roberts ..... B65G 17/002
2019/0055746 A1* 2/2019 Lin ..... E04H 6/22

FOREIGN PATENT DOCUMENTS

DE 4407163 C1 6/1995
WO 2010076964 A2 7/2010

OTHER PUBLICATIONS

International Preliminary Report on Patentability for corresponding Application No. PCT/TR2021/050570 issued Dec. 13, 2022.
Written Opinion and International Search Report for corresponding Application No. PCT/TR2021/050570 issued Nov. 24, 2021.

* cited by examiner

*Primary Examiner* — Glenn F Myers
(74) *Attorney, Agent, or Firm* — Renner, Otto, Boisselle & Sklar, LLP

(57) ABSTRACT

The invention relates to a system that allows pallets with or without vehicles to be transferred to and from the building or floors of the parking lot via palletized vehicle lifts or palletized horizontal carrier systems carrying vehicles in fully automated parking systems.

5 Claims, 12 Drawing Sheets

AUTOMATED PARKING FLOOR CONVEYOR SYSTEMS

This application is a national phase of International Application No. PCT/TR2021/050570 filed Jun. 11, 2021, which claims priority to Turkish Application No. 2020/09190 filed Jun. 15, 2020, each of which is hereby incorporated herein by reference in its entirety.

TECHNICAL FIELD

The invention relates to a system that allows pallets with or without vehicles to be transferred to and from the building or floors of the parking lot via palletized vehicle lifts or palletized horizontal carrier systems carrying vehicles in fully automated parking systems.

PRIOR ART

In the previous techniques, in the systems used to deliver pallets to the parking floors, the rack systems on the parking floors are mechanisms without a drive system (non-motorized). The carrier system pushes or pulls the pallet to the rack mechanisms with the push-and-pull mechanism on it in order to deliver and receive the pallet to the floor shelves. The pallets are connected to each other by the hooks on them. Thus, when the carrier system reaches the floor level, it pushes the pallet on the empty shelf or takes the pallet on the shelf by means of its mechanism.

In the prior art, since the parking lot floor racks are plain racks without a drive system, they remain passive and uncontrolled compared to the invention. As the floor shelves are passive, they contain a pallet exchange system on the carrier system, which is more functional and efficient than the carrier system of our invention. In our invention, the role of pallet exchange has been transferred to the floor conveyors by reducing the carrier system functions, thus independent control has been ensured on the floors and the payload of the carrier systems has been reduced.

BRIEF DESCRIPTION OF THE INVENTION

The invention relates to a system that allows pallets to be transferred to and from the building or floors of the parking lot via palletized vehicle lifts or palletized horizontal carrier systems carrying vehicles in fully automated parking systems. In other words, it enables the vehicle to be transferred to and from the shelves of the multi-storey car park via carrier systems. This design, which has a conveyor mechanism on it, can be designed as a system with one or more pallets. On this design, which is called the floor conveyor system, there is an electric gear motor drive system providing independent control. In addition, there is a pallet locking system on the system, which is described as a sensor controlling pallet movements and a floor locking mechanism with sensors.

LIST OF FIGURES

Figure 1:
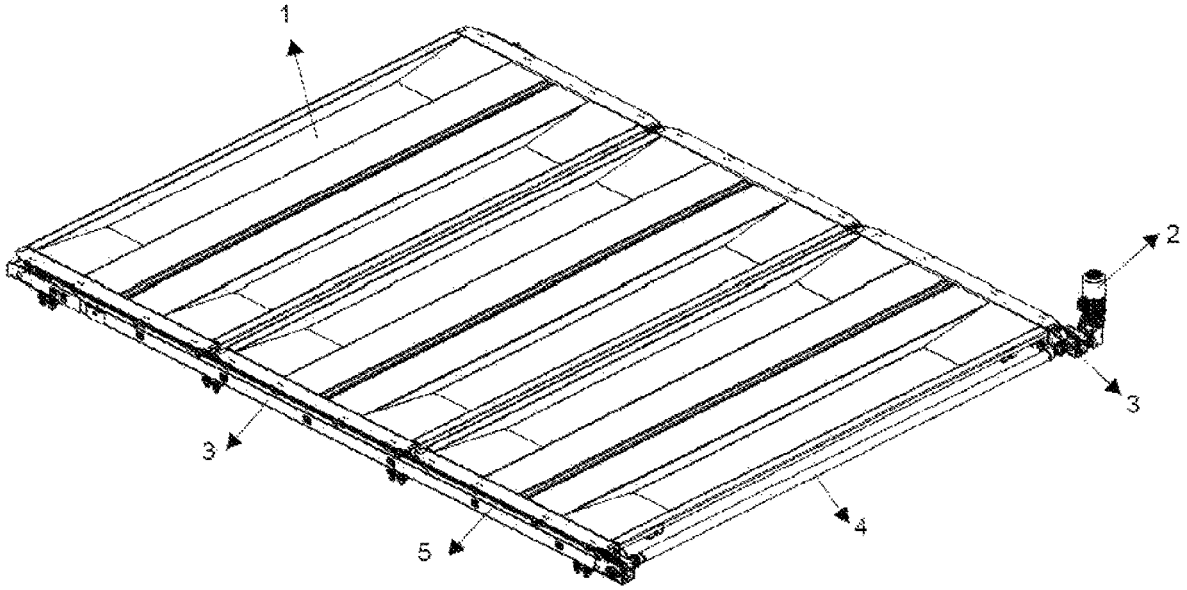

FIG. 1. Isometric View of Independent Driven Floor Conveyor

Figure 2:
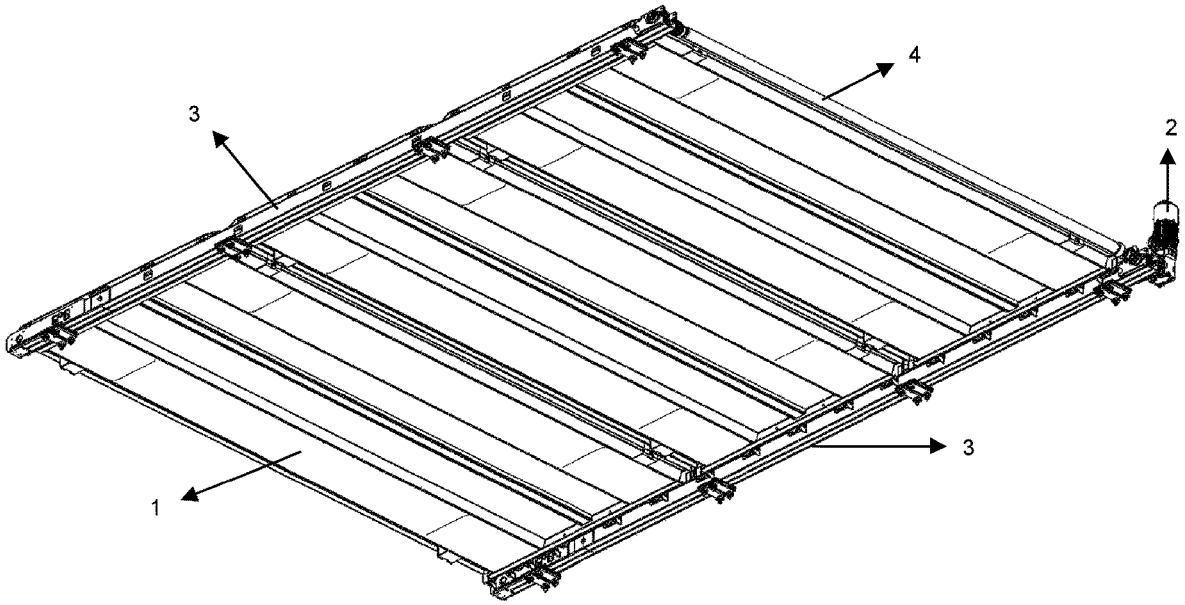

FIG. 2. Isometric Bottom View of Independently Driven Floor Conveyor

Figure 3:
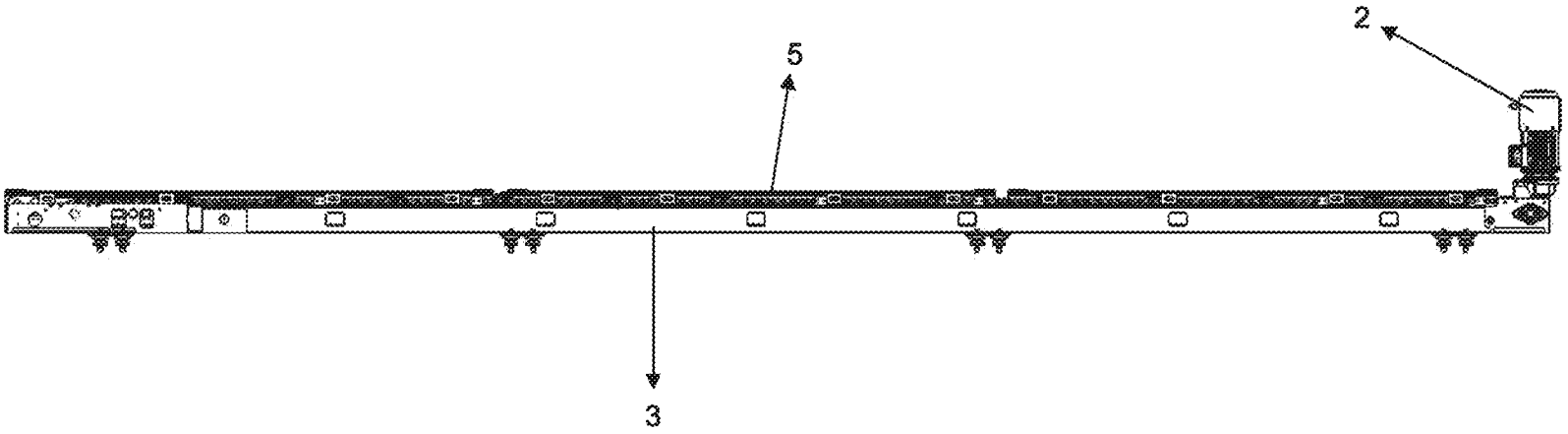

FIG. 3. Side View of Independently Driven Floor Conveyor

Figure 4:
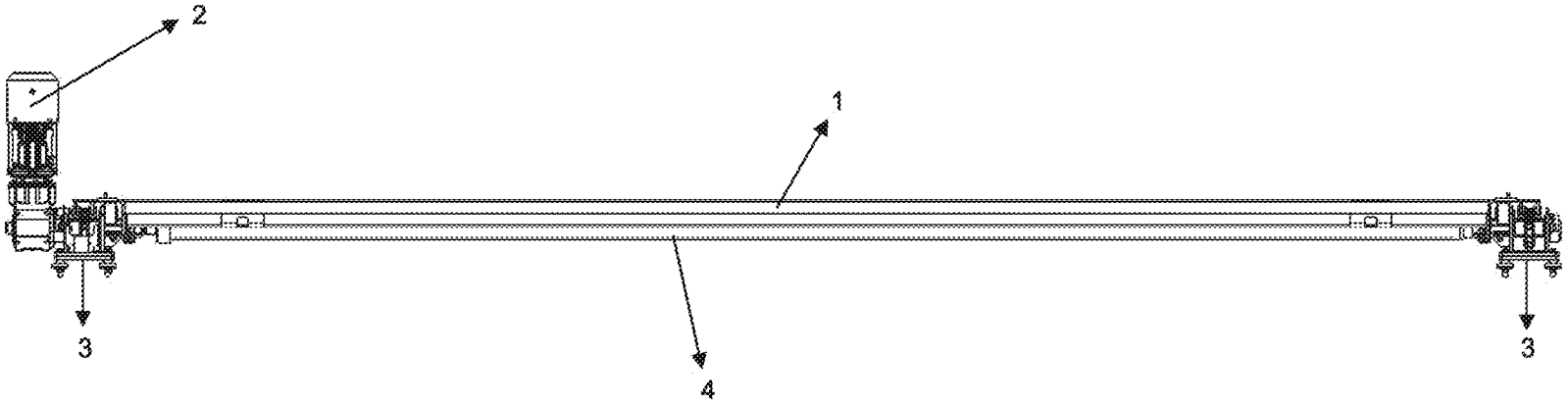

FIG. 4. Front View of Independently Driven Floor Conveyor

Figure 5:
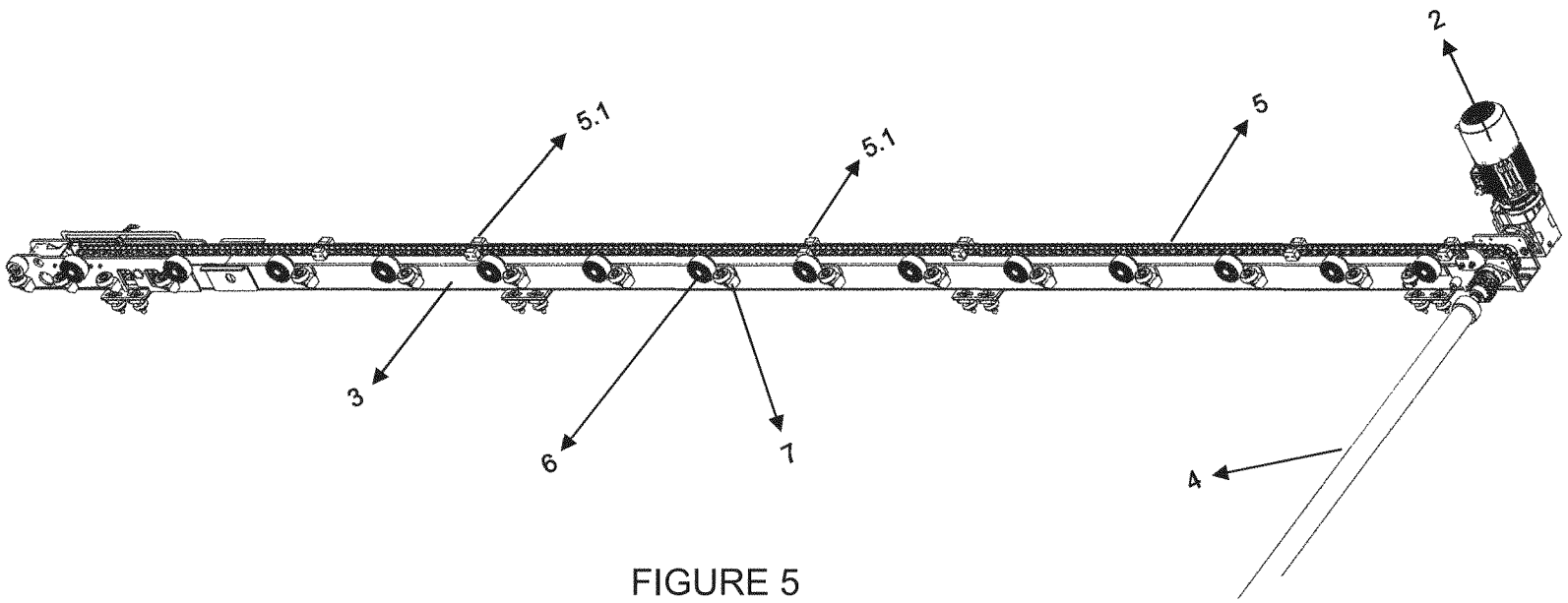

FIG. 5. Detail View of Independently Driven Floor Conveyor

Figure 6:
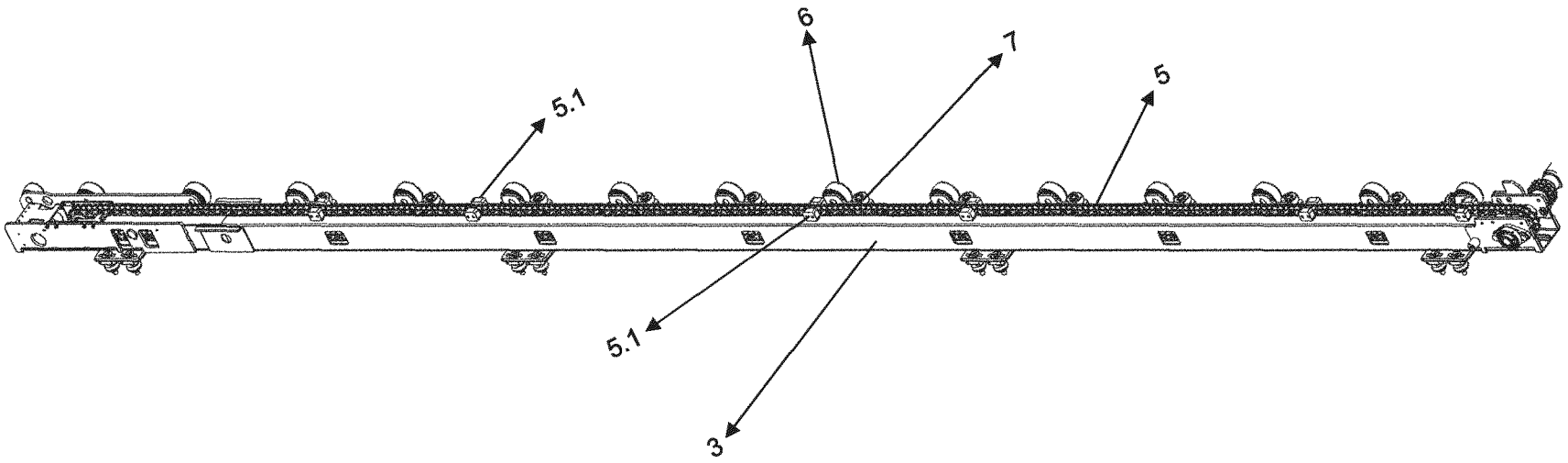

FIG. 6. Detail View of Independently Driven Floor Conveyor

Figure 7:
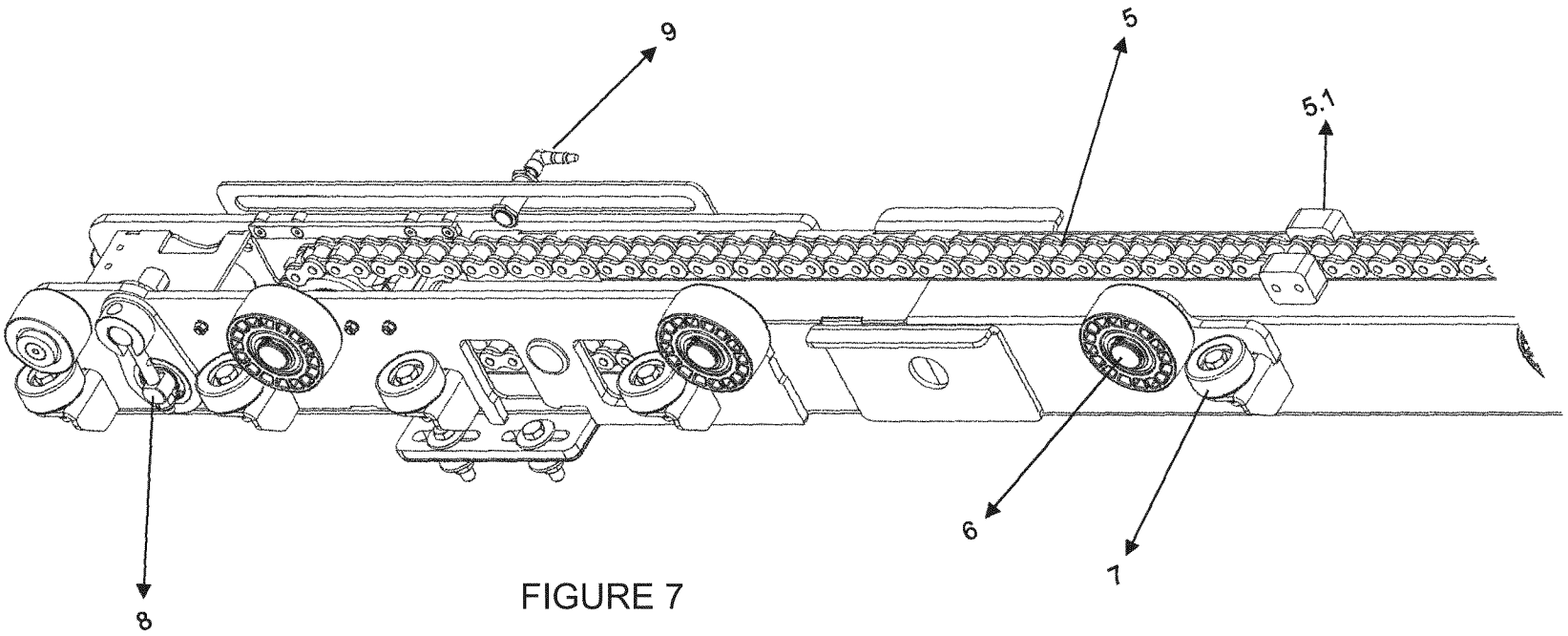

FIG. 7. Detail View of Independently Driven Floor Conveyor

Figure 8:
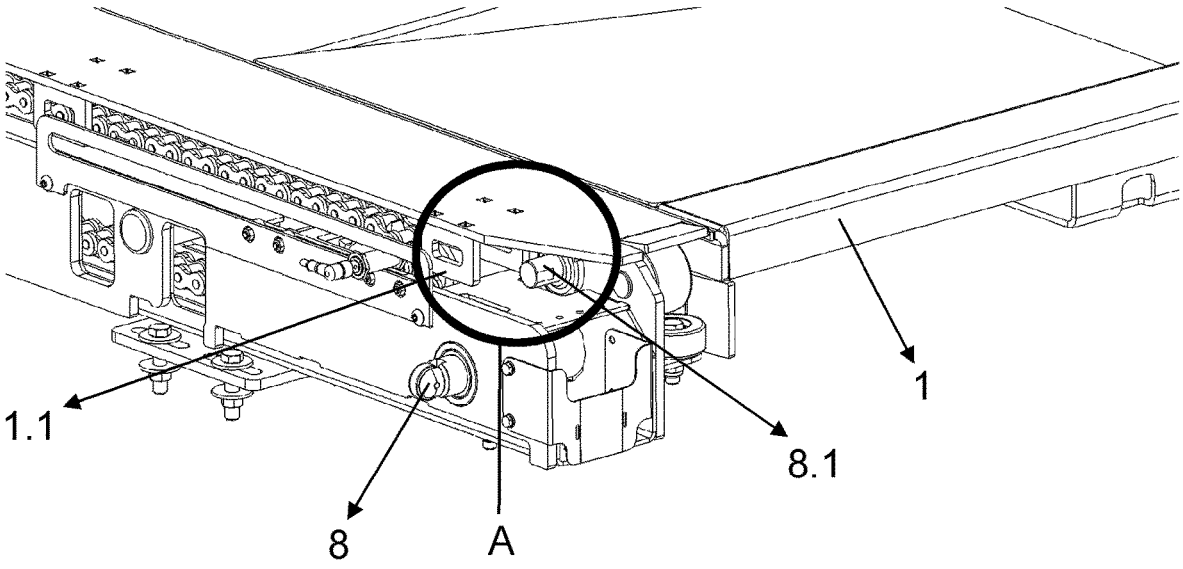

FIG. 8. Detail View of Conveyor Mechanism End Part

Figure 9:
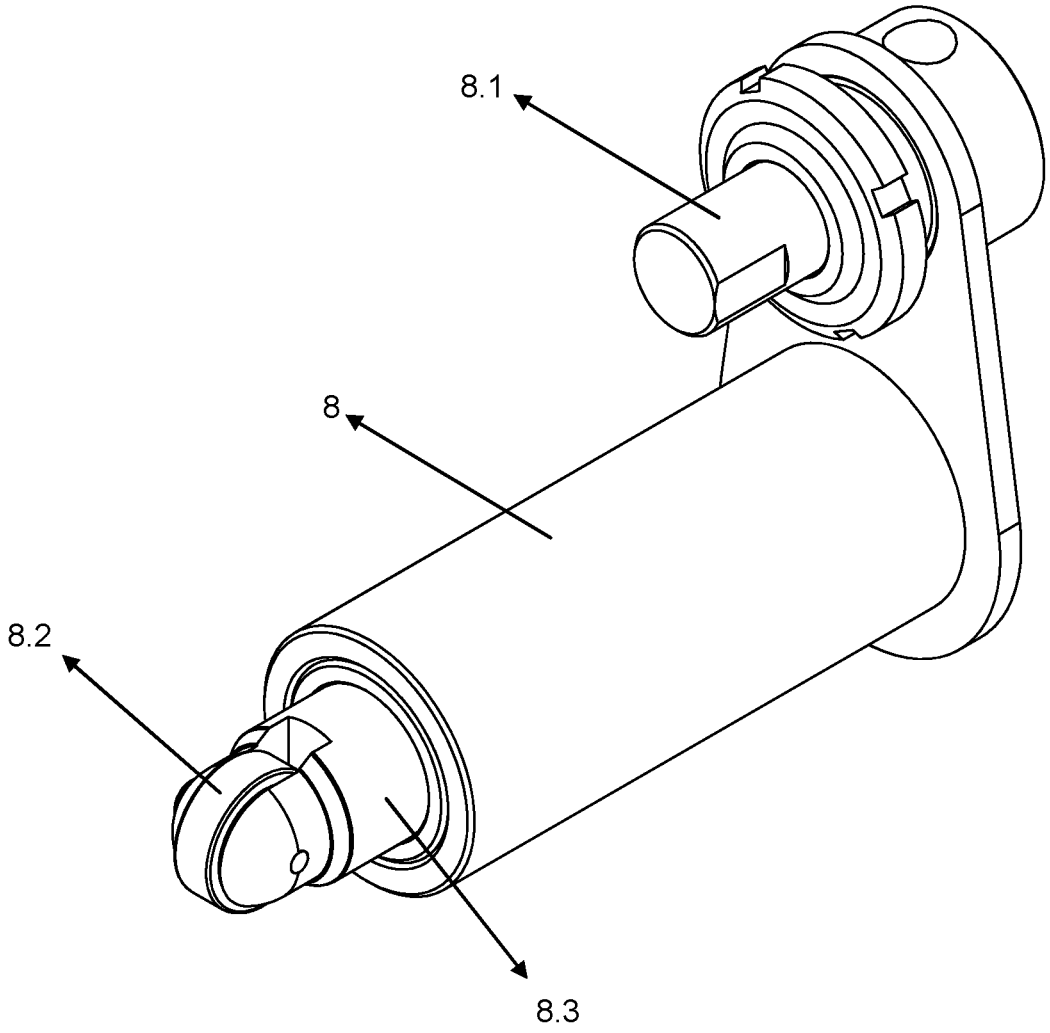

FIG. 9. A Detail View

Figure 10:
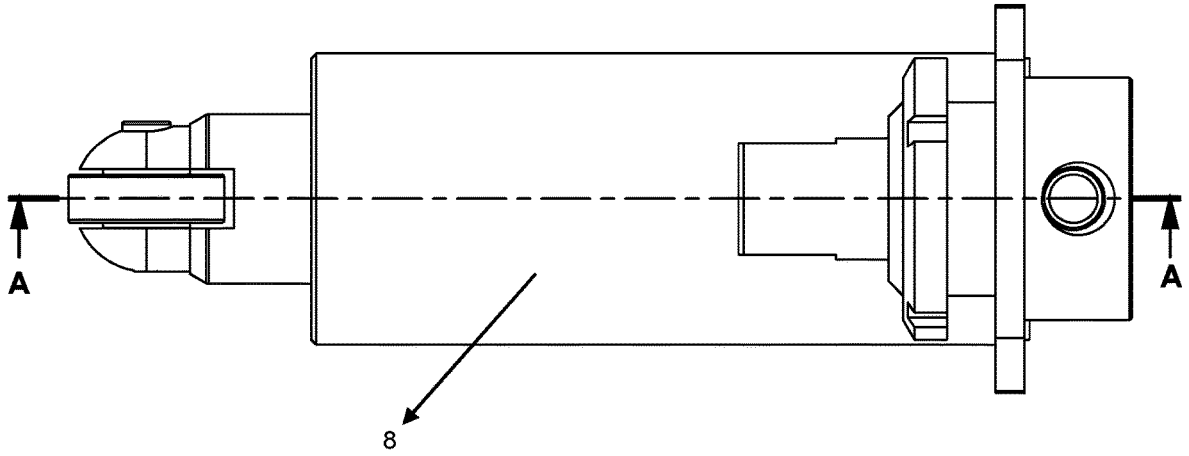

FIG. 10. Top View of Floor locking Mechanism

Figure 11:
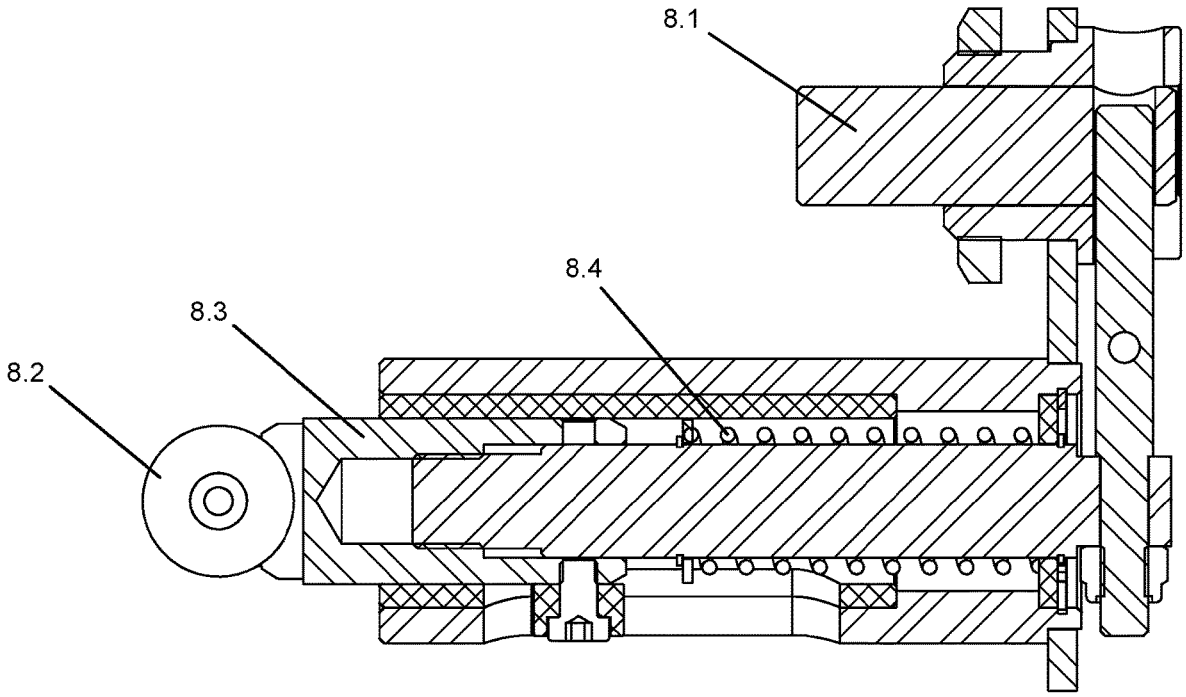

FIG. 11. A-A Sectional View

Figure 12:
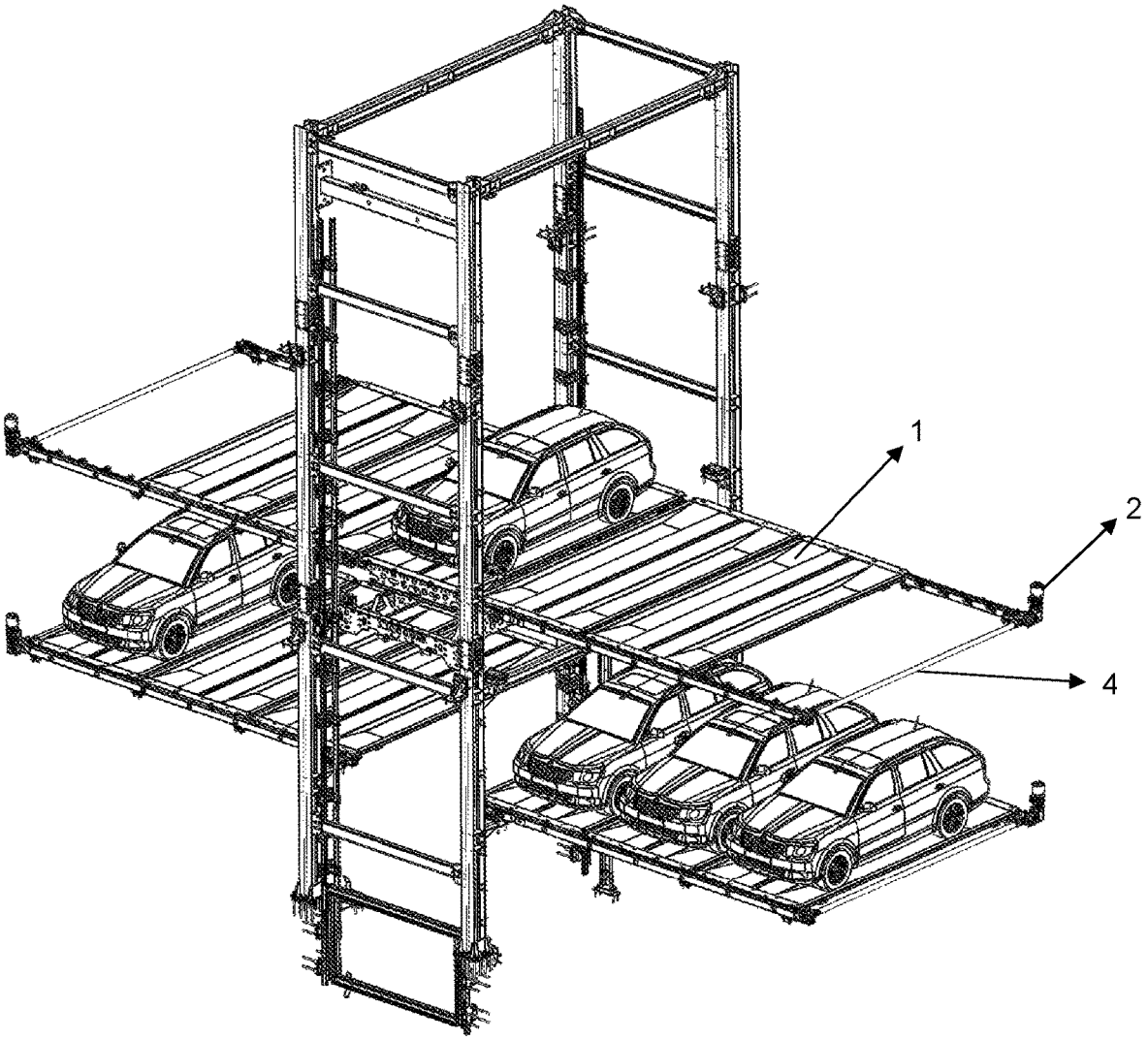

FIG. 12. Application example of independently driven floor conveyor and system as a whole Meaning of the part numbers assigned in the FIGS.

1. Palette
2. Electric gear motor
3. Conveyor mechanism
4. Torsion bar assembly
5. Conveyor chains
6. Pallet transport wheel
7. Pallet guide wheel
8. Floor locking mechanism
9. Motion control sensor

DETAILED DESCRIPTION OF THE INVENTION

Fully automated parking systems are modern unmanned parking systems consisting of parking floors, where tens or hundreds of vehicles can be parked together. They are fully automatic computer-controlled systems that organizes subsystems such as vertical vehicle carrier lift, horizontal vehicle carrier or integrated mechanisms where they are applied together, main engine group, counterweight, and floor conveyor, which is our subject matter, properly. After leaving the room, they write the license plate information of the vehicle they parked on the touch screen user control panel, and after they enter the information, the system sends their vehicles to the sections on the appropriate parking floors. The driver re-enters the license plate information on the control panel to recall his vehicle from the system. The system takes the vehicle from the parking area on the floors and brings it to the vehicle entrance room. The driver enters through the pedestrian gate and receives his vehicle. As you can see, parking and recalling the vehicle after the vehicle entrance room is fully automated by the system.

Automatic parking systems are systems that have been used for many years, and the structures of the components that make up the system affect the whole system. It changes the functional roles, and the efficiency and the capacity of the system. The plain shelves on the floors in the previous systems both create an extra workload on the carrier systems and adversely affect the capacity of the car park. The floor conveyors in our invention have their own conveyor systems, and as independent machines, they play a unique role in the parking and forwarding of vehicles on the floors and perform their own work. Thus, they take the functional load over the carrier systems, that is, the floor conveyors themselves carry out the exchange of vehicles at the parking floors.

The invention relates to a system comprised of pallet (1), electric gear motor (2), conveyor mechanism (3), torsion bar assembly (4), conveyor chains (5), pallet transport wheel (6), pallet guide wheel (7), pallet locking floor locking mechanism (8) pallet motion control sensor (9) parts and automation system, allowing the vehicles to be parked on the parking floors as a component of the fully automated parking system with the combination of these parts.

When the floor conveyor system, which allows the vehicle to be parked on the floors after receiving the vehicle brought by the driver and conveying it to the parking floors with the carrier, is considered together with the drawings from FIG. 1 to FIG. 7; it is the entire system comprised of the pallet (1) on which the vehicles are transported; the electric gear motor (2) that ensures the independent operation of the system; the conveyor mechanism (3) on the right and left of the system, which moves the pallet; the Torsion bar assembly (4) that provides the simultaneous operation of the conveyor mechanisms on the right and left sides and serves as power transmission system; conveyor chains (5) containing the chain assembly that moves the pallet with the wedges on the chain that makes contact with the claws on the pallet; the pallet transport wheels (6) that ensure the contact of the pallet with the conveyor and are connected to the conveyor; adjustable pallet guiding wheels (7) that keep the pallet aligned, and again ensure the contact of the pallet with the conveyor and operate laterally as connected to the conveyor; the floor locking mechanism (8) that in the absence of the carrier system, prevents the pallets on the floor conveyor from falling into the parking space and locks the pallet in an undesirable situation; motion control sensor (9) that reads the pallet movements, i.e., exchange data with the wedges attached to the pallet on the conveyor chains.

The shelves on the floors of the parking systems mentioned in the previous art do not contain the parts of our invention, and they only consist of a plain parking floor with shelf-arms on the right and left side with pallets on them.

In this section, the functions of the parts that make up our invention will be explained.

Pallet (1): It is a vehicle-carrying steel platform made of steel sheet material, manufactured as welded and watertight with wheel spaces allowing vehicles to park comfortably. On the short sides of the pallet (1), there are pallet claws (1.1) that snag to the conveyor chain wedge (5.1) and enable it to move together with the chain wedge (5.1). While the conveyor mechanism (3) is operating, the attachments on the conveyor chain (5) snag to the pallet claws (1.1) and pull or push the pallet (1) to the parking floors or elevators with the vehicle or as empty. The method of moving the elevator pallet (1) is different. While the conveyor pallet (1) is pulled and pushed by the chain, the elevator pallet (1) is moved by rubbing the polyurethane wheels against the bottom surface of the pallet. For the drive of the pallet (1) by the elevator, a smooth surface is formed on the two short sides. These are the surfaces that also support and guide the pallet.

Electric Gear Motor (2): The main drive part that is formed by the combination of the gearbox and the motor, is the standard products manufactured by being calculated according to the floor conveyor system loads and parameters by different companies in the selected machinery market. It is the main equipment of the drive system that moves the floor conveyor system. Provides linear movement to the chains by rotating the conveyor torsion shaft.

Conveyor mechanism (3): There are two conveyor mechanisms (3) located symmetrically to each other on the right and left sides of the floor conveyor system. These mechanisms are symmetrical to each other in structure. They are manufactured in a length determined according to the number of vehicles to be parked side by side. Each mechanism (3) is designed to be durable enough to safely carry all the equipment and vehicle(s) on it. For this purpose, there is a chassis made of steel box profile and welded sheet metal parts to transport and support the entire mechanism. On this chassis, there are conveyor chain (5); chain guideway for providing linear movement of the conveyor chain (5); gear group for drive transmission; wheel assemblies (6 and 7) for guiding and transporting the pallet; electric gear motor (2) to drive the system; chain tightener; torsion bar (4) attachment points; floor locking mechanism (8); motion control sensor (9).

Torsion bar assembly (4): Torsion bar assembly (4) is the assembly that forms the conveyor mechanism and is placed between these mechanisms (3) and is connected with a chain gear coupling in order to enable the symmetrical right and left conveyor mechanisms (3) to move simultaneously. It is a steel pipe with a length suitable for the distance between the conveyor mechanisms with chain gears on both sides and this distance can be adjusted in short intervals. Since the gear assembly on one side of the torsion bar assembly (4) is fixed and the other side is in the form of a conical lock mechanism, it has an adjustable structure. Thus, it is connected to the conveyor mechanisms (3) on both sides as adjusted and with chain couplings without any problems, thus making the fieldwork practical.

Conveyor chains (5): Conveyor chains (5), which are the main parts of the floor conveyor, consist of chain wedge (5.1) parts, which consist of standard chains, but are designed according to the pallet (1) and can be mounted on the chain. Chain wedges (5.1) snags onto the claws located under the pallet (1), ensuring that the chain movement is transmitted to the pallet (1) in both directions. Chain wedge assembly (5.1), in numbers depending on the pallet capacity of the floor conveyor system, are mounted by positioning on the conveyor chain (5). Thus, the wedge assembly of each pallet (1) is different. The conveyor chain (5) also ensures that the distance between the pallets (1) remains constant and thus prevents the pallets from colliding with each other.

Pallet transport wheel (6): It is the plastic wheel with low friction and providing contact without damaging the pallet surface in order to ensure the horizontal movement of the pallets (1) on the conveyor easily and to carry the pallets without requiring very high force. This wheel assembly is manufactured by plastic injection moulding with special design content. Thanks to the quality and dimensions of the selected plastic material, it can carry a minimum weight of 1000 kg. Double row bearings are used in wheel bearings to reduce friction and maintenance effort. The upper surface of the wheel is radiused. Thanks to this radius, the wheel can contact the pallet surface in a wider area. The wheel can be easily mounted on the welded shafts on the conveyor chassis.

Pallet guiding wheel (7): The pallets (1) on the conveyor must be precisely positioned according to the elevator position and must be moved easily without requiring too high engine power. To achieve this, plastic wheels are used on the conveyor chassis at regular intervals. This wheel group is manufactured by plastic injection moulding with special design content. Bearings are used in wheel bearings to reduce friction and maintenance effort. The wheels can be easily mounted on the welded shafts on the conveyor chassis.

Floor locking mechanism (8): There is a floor locking mechanism (8) that interacts with the carrier working at floor levels in order to prevent the pallet (1) from falling into the empty space by considering the possibility of the floor conveyors on the parking floor acting as if it is delivering the pallet (1) on the conveyor to the carrier when in fact there is no carrier in line with it, as a result of an error or malfunction. Since the floor locking mechanism (8) can only be opened by the unlocking mechanism on the carrier, it is not possible for the pallet (1) to move off the conveyor under any circumstances, when the carrier is not on the floor. As shown in FIG. 8, the floor locking mechanism (8) becomes active when there is no carrier in line with it, and as in A Detail view, the lock tongue (8.1) stops in front of the pallet claw (1.1) and prevents the unintentional movement of the pallet (1). When the carrier comes to the level of the floor conveyor, the lock tongue (8.1) is pulled in and the obstacle in front of the pallet claws (1.1) is removed. Thus, the pallet (1) is released. Since the lock tongue (8.1) is pushed by a spring (8.4), the lock remains closed whenever the elevator is not at the floor. In addition, there is a bearing body shaft (8.3) at the drive end of the floor locking mechanism (8) and there is an end bearing (8.2) at the end of the bearing body shaft. The end bearing (8.2) is placed to reduce friction during the perpendicular movements of the carrier.

Motion control sensor (9): The positions of the sequential pallets (1) on the floor conveyor and when the conveyor will start and stop are controlled by the motion control sensor (9). This sensor is the proximity (distance) sensor (9) type. The location and the mounting method of the motion control sensor (9) are shown in FIG. 7. This sensor (9) sees the chain wedges (5.1) on the conveyor chain (5) and determines how many pallets are on the conveyor and also detects the times when the conveyor should stop or run. It transmits the reading information to the automation centre along with the counting process in order to control the arrangement and positions of the pallets (1) on the floor conveyor.

As seen in FIG. 10, when the vehicle lift, which is shown as a carrier in the exemplary fully automatic parking system setup, wants to park the vehicle or take out the vehicle in the park on it during its up and down movements by being guided within the elevator tower, it stops at the level of the parking lot and interacts with the floor conveyor to perform the task sharing process and completes the cycle.

The invention claimed is:

1. A floor conveyor system for automated parking, comprising:

a pallet made of water-proof and welded sheet steel material, with wheel cavities to allow vehicles to park comfortably, and with a smooth surface on two short sides in order to be driven by an elevator, an electric gear motor that enables the system to work independently, a conveyor mechanism consisting of a chassis made of steel box profile and welded sheet metal parts, positioned symmetrically on the right and left of the system, and transferring movement to the pallet, a torsion bar assembly, enabling synchronous operation of the conveyor mechanisms on the right and left sides, having a power transmission function and the torsion bar assembly is connected to the conveyor mechanism with a chain gear coupling, and includes a gear group that is fixed on one side and has a conical lock mechanism on the other side, conveyor chains, a pallet transport wheel that ensures the contact of the pallet with the conveyor mechanism and is connected to the conveyor mechanism, and is supported by a double-row roller bearing and having a radiused upper surface, a pallet guiding wheel that ensures the contact of the pallet with the conveyor mechanism, and is working sideways and is keeping the pallet aligned, a floor locking mechanism which prevents the pallets on the floor conveyor from falling into the parking space in an undesired situation and locks the pallet, in the absence of a carrier system, a motion control sensor part that reads the pallet movements, that is, receives and transmits data from chain wedges attached to the pallet on the conveyor chains.

2. The floor conveyor system of claim 1 wherein the short sides of the pallet contains pallet claws that snag to a conveyor chain chock and allow it the pallet to move together with the chain chock.

3. The floor conveyor system of claim 2, wherein the pallet claws are positioned asymmetrically on the pallet.

4. The floor conveyor system of claim 1 wherein the conveyor chain contains the chain wedges in numbers equal to the pallet capacity of the floor conveyor system that enables the chain movement to be transmitted to the pallet in both directions by snagging to claws located under the pallet.

5. The floor conveyor system of claim 1, wherein the floor locking mechanism contains a lock tongue that prevents the unintentional movement of the pallet by standing in front of pallet claws, which is active when there is no carrier at the level of the floor locking mechanism and, when the carrier is at the level of the floor conveyor, pulls in and releases the pallet by removing the obstacle in front of the pallet claws.

* * * * *